US005636679A

United States Patent [19]

Miller et al.

[11] Patent Number: 5,636,679

[45] Date of Patent: Jun. 10, 1997

[54] RETRACTABLE GATE

[76] Inventors: Miles Miller, 7761 N. Point Creek Rd., Baltimore, Md. 21219; Mike Becker, 8 Strawhill Ct., Owings Mills, Md. 21117

[21] Appl. No.: 391,364

[22] Filed: Feb. 21, 1995

[51] Int. Cl.[6] ..... E06B 11/02

[52] U.S. Cl. ..... 160/317; 160/23.1; 160/290.1; 160/231.1

[58] Field of Search ..... 160/23.1, 24, 99, 160/100, 290.1, 317, 231.1, 29, 133

[56] References Cited

U.S. PATENT DOCUMENTS

| | | | |
|---|---|---|---|
| 1,295,712 | 2/1919 | Drew | 160/231.1 X |
| 1,393,405 | 10/1921 | Soteros et al. | 160/23.1 X |
| 1,908,989 | 5/1933 | Lahey et al. | 160/25 |
| 1,958,695 | 5/1934 | Claus | 160/23.1 |
| 2,099,068 | 11/1937 | Keithly | 160/23.1 |
| 2,624,402 | 1/1953 | Lukasavicz | 160/23.1 |
| 5,505,244 | 4/1996 | Thumann | 160/23.1 |

*Primary Examiner*—Anthony Knight

[57] ABSTRACT

The retractable gate of the invention includes a housing, the housing having a central core retractably directing a flexible web within the housing, that in turn is directed from the housing at a first side of a portal opening to a second side of the portal opening to prevent ease of egress therethrough by pets as well as small children.

5 Claims, 3 Drawing Sheets

RETRACTABLE GATE

TECHNICAL FIELD

The field of invention relates to containment gate structure, and more particularly to a retractable gate wherein the same is directed to extend over a portal opening to prevent ease of egress therethrough by pets, small children, and the like.

BACKGROUND OF THE INVENTION

Prior art gate structure has been directed to children, per se, wherein the instant invention is directed to encompass the preventing of pets such as cats, dogs, and the like from access through a portal opening and to this end, a housing contains a retractable web extensibly contained relative to the housing for fastening to an opposed side of the portal opening.

SUMMARY OF THE INVENTION

The retractable gate of the invention includes a housing, the housing having a central core retractably directing a flexible web within the housing, that in turn is directed from the housing at a first side of a portal opening to a second side of the portal opening to prevent ease of egress therethrough by pets as well as small children.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. therefore, specific structural and functional details disclosed herein are not to be interpreted as limiting, but merely as a basis for the claims and as a representative basis for teaching one skilled in the art to variously employ the present invention in virtually any appropriately detailed structure.

Figure 7:
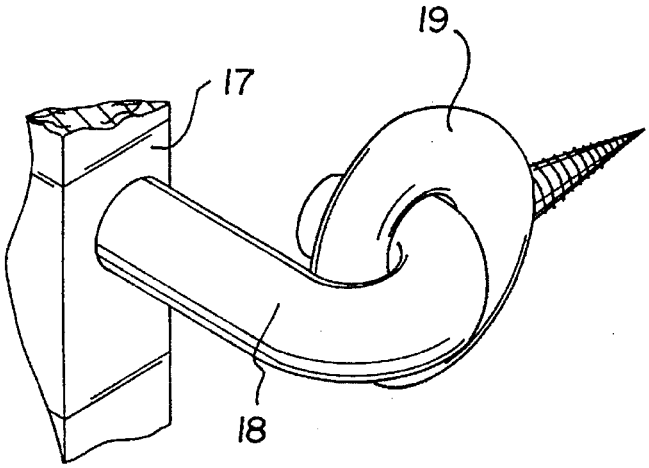
FIG. 7 is an enlarged perspective illustration of the clamp member structure employed by the web to secure the web on an opposed side of the associated portal opening.

The retractable gate 10 of the invention comprises attachment of the gate 10 to a first door member frame 11, such that the door member frame 11 defines a door opening 12 therewithin, with the housing 14 of the gate 10 secured adjacent to the floor 13 of an associated dwelling. Retractably mounted within the housing 14 is a flexible web 15, having a web distal end 16 having fixedly secured thereto a rigid flange 17. A plurality of first clamp members 18 indicated as hooks are secured to the rigid flange 17, such that the first clamp members 18 are arranged for attachment to second clamp members 19 indicated as hook-receiving eyes in FIG. 7. The first clamp members 18 attach the rigid flange 17 and cooperate with the second clamp members 19 that are in turn mounted to an opposed side of the door opening 12 relative to the housing 14 and its attachment to a first side of the door member frame 11. The second clamp members 19 may be attached to the frame 11 or to the associated wall structure, but the second clamp members 19 are typically mounted to an opposed side of the opening 12.

The housing 14 itself includes a first side wall 20 spaced from a second side wall 21, a top wall 22 spaced from a bottom wall 23. A front wall 24 is removably mounted relative to the housing to indicate a cavity 25 within the housing, with the front wall 24 permitting access within the cavity for repair and replacement of various components within the housing, such as the web 15 and associated structure therewith.

Figure 1:
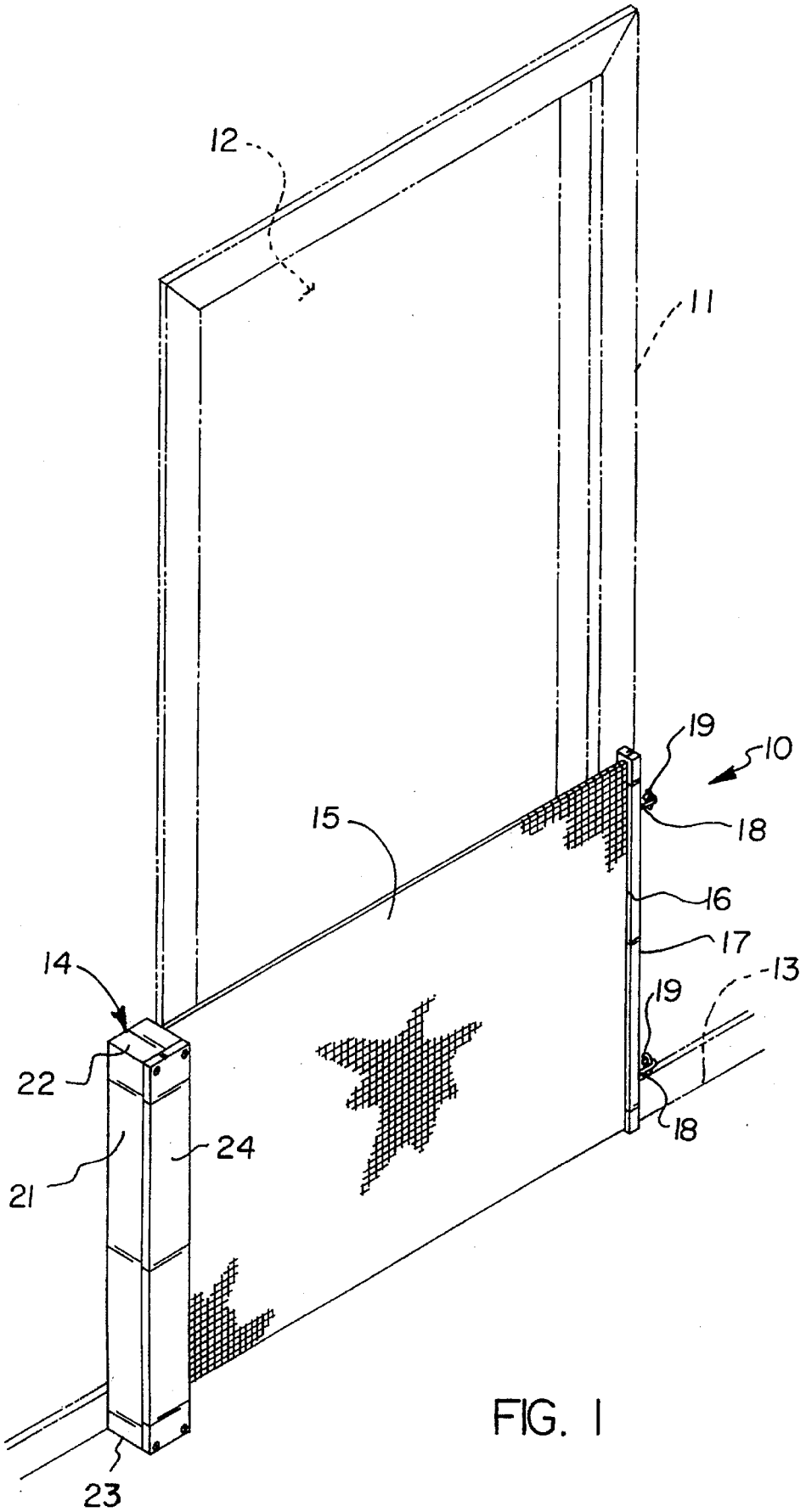
FIG. 1 is a perspective illustration of the invention in use.
Figure 2:
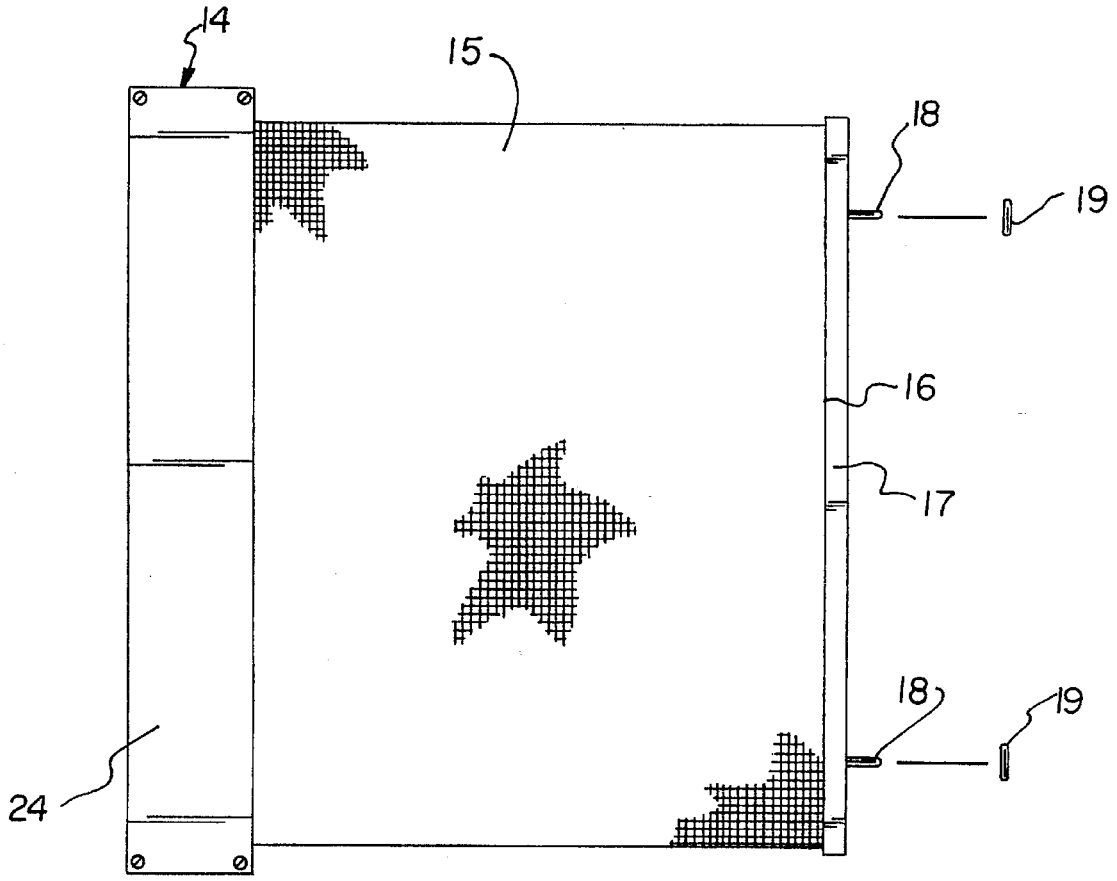
FIG. 2 is a frontal elevational view of the invention indicating the web extended therefrom.
Figure 3:
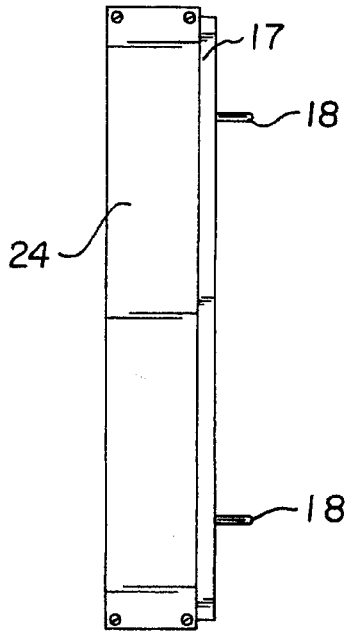
FIG. 3 is an elevational frontal view of the invention indicating the web retracted within the housing.
Figure 4:
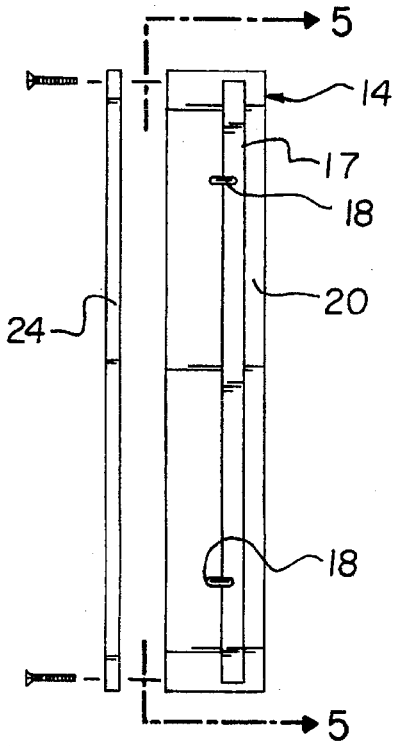
FIG. 4 is an elevational side view of the invention indicating the front wall separated therefrom to indicate the web contained within the housing cavity.
Figure 5:
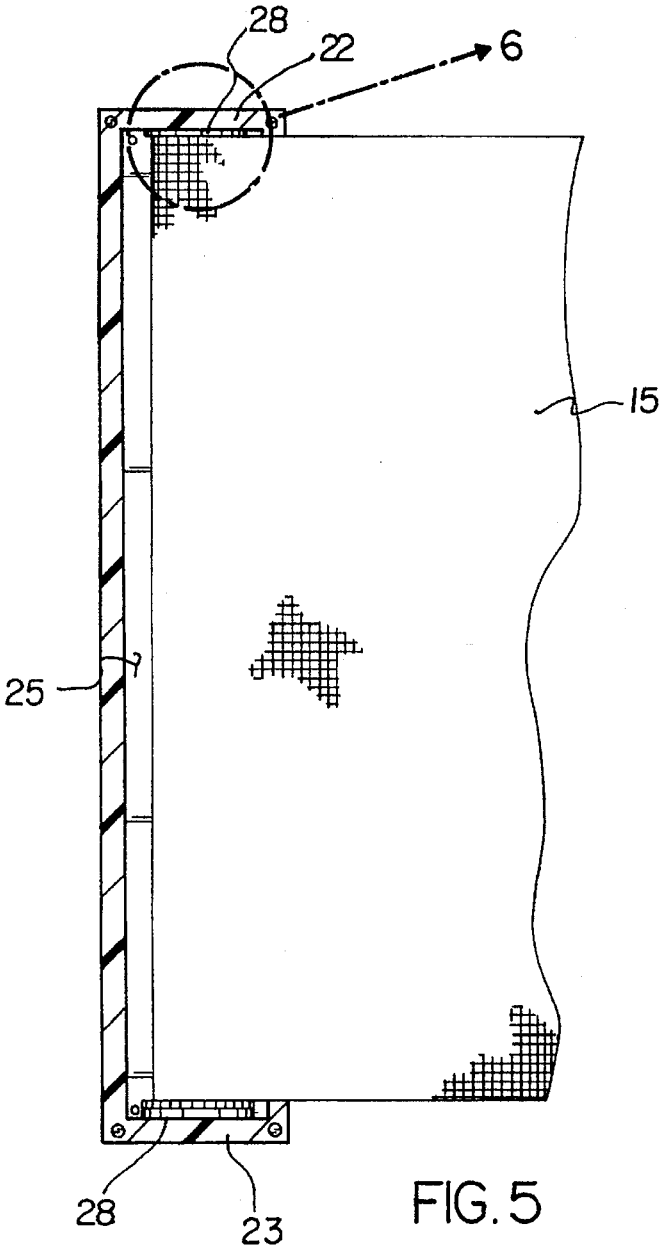
FIG. 5 is an elevational view, taken along the lines 5—5 as indicated in FIG. 4.
Figure 6:
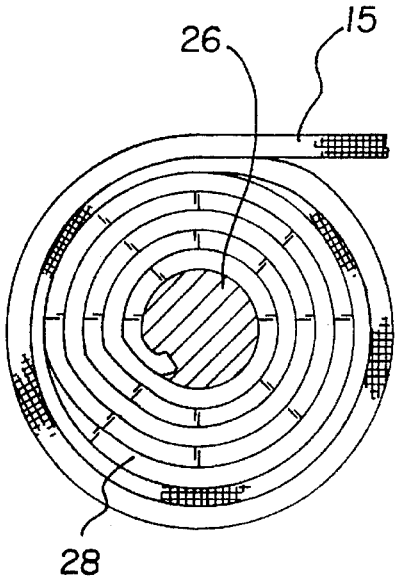
FIG. 6 is an enlarged top plan view of section 6 as set forth in FIG. 5.

A central core 26 is rotatably mounted to and extends between the top wall 22 and the bottom wall 23, with at least one return spring 28 secured to the central core 26 and to the top wall 22, and typically of a second return spring mounted to the core and to the bottom wall 23, such as indicated in FIG. 5. In this manner, the web 15 is normally biased for retraction within the housing, whereupon extension of the web 15 from the housing slidably through the first side wall 20 compresses the spring to bias retraction of the web 15 within the housing cavity 25 for storage of the web structure during periods of non-use, such as indicated in FIG. 3.

As illustrated, however, for use of the invention the web 15 is merely extended from the housing 14 through the first side wall 20 and to this end, extended to overlie the door opening 12 for attachment to the first clamp members 18 to the second clamp members 19.

It is to be understood that while certain forms of the present invention have been illustrated and described herein, it is not to be limited to the specific forms or arrangement of parts described and shown.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed and desired to be protected by Letters Patent of the United States is as follows:

1. A retractable gate, comprising, a housing, the housing including a housing front wall, a housing first side wall spaced from a housing second side wall, a housing top wall and a housing bottom wall spaced from the housing top wall, with a central core rotatably mounted and extending between the top wall and the bottom wall, with the core having a flexible web attached to the central core, and the web extending from the housing through the housing first side wall and terminating in a distal end, with a rigid flange secured to the web distal end to prevent retraction of the flange within the housing, and the web extensible from the first position furled within the housing to a second position, with web extended relative to the housing, and attachment means for securing the web in the second position, and at least one return spring attached directly to the central core and the housing top wall to bias the web to the first position.

2. A gate as set forth in claim 1 wherein a further return spring is attached directly to the core and to the housing bottom wall.

3. A gate as set forth in claim 1 wherein the front wall is removably mounted relative to the housing to provide access within the housing for maintenance of the web within the housing.

4. A gate as set forth in claim 1 wherein the attachment means comprises first clamp members secured to the rigid flange, and second clamp members spaced from the rigid flange, wherein the second clamp members are arranged for attachment to an opposed side of a portal opening relative to the housing.

5. A gate as set forth in claim 4 wherein the first clamp members comprise hooks and the second clamp members comprise eyes for receiving the hooks therein.

* * * * *